United States Patent [19]

Sargent et al.

[11] Patent Number: 5,073,994

[45] Date of Patent: Dec. 24, 1991

[54] LOW WATER TOILET WITH PULSED FLUSH

[75] Inventors: Charles L. Sargent; Michael A. Wolcott; John M. Antos, all of Ann Arbor, Mich.

[73] Assignee: Thetford Corporation, Ann Arbor, Mich.

[21] Appl. No.: 581,530

[22] Filed: Sep. 12, 1990

[51] Int. Cl.[5] ..... E03D 5/12; E03D 1/24

[52] U.S. Cl. ..... 4/332; 4/432

[58] Field of Search ..... 4/300, 229, 330, 331, 4/332, 345, 431, 432; 417/34, 395

[56] References Cited

U.S. PATENT DOCUMENTS

| | | | |
|---|---|---|---|
| 866,368 | 9/1907 | Landell et al. | 4/432 |
| 1,242,200 | 10/1917 | Keating | 4/345 |
| 2,068,406 | 1/1937 | Freed | 4/378 |
| 3,251,068 | 5/1966 | Milette et al. | 4/431 |
| 3,860,973 | 1/1975 | Uyeda et al. | 4/332 |
| 3,932,901 | 1/1976 | Inui et al. | 4/332 |
| 3,939,501 | 2/1976 | Sargent | 4/329 |
| 4,185,337 | 1/1980 | Sargent et al. | 4/321 |
| 4,204,812 | 5/1980 | Sheppard | 417/395 |
| 4,232,409 | 11/1980 | Van Pham | 4/433 |
| 4,439,874 | 4/1984 | Schrock | 4/332 |
| 4,510,629 | 4/1985 | Jovy et al. | 4/332 |
| 4,926,508 | 5/1990 | Sargent et al. | 4/319 |

FOREIGN PATENT DOCUMENTS

| | | | |
|---|---|---|---|
| 0348766 | 8/1905 | France | 4/332 |
| 2381923 | 10/1978 | France | 417/349 |
| 0049828 | 2/1990 | Japan | 4/329 |
| 0432306 | 11/1974 | U.S.S.R. | 417/349 |

*Primary Examiner*—William A. Cuchlinksi, Jr.
*Assistant Examiner*—John L. Beres
*Attorney, Agent, or Firm*—Harness, Dickey & Pierce

[57] ABSTRACT

A low water flush toilet having a bowl with a horizontal ledge extending around the bowl periphery near its open upper end with a flush water nozzle on the ledge for discharging water in a generally horizontal direction onto the ledge. A pulsator is provided for producing pulses of flush water that are discharged onto the ledge with the water of each pulse flowing at varying velocities such that as the water flows around the ledge, some of the water will fall off the ledge around substantially the entire periphery of the bowl resulting in wetting of the entire bowl surface for cleaning the bowl. The pulsator includes a spring biased piston for discharging pulses of water.

15 Claims, 6 Drawing Sheets

LOW WATER TOILET WITH PULSED FLUSH

BACKGROUND AND SUMMARY OF THE INVENTION

The present invention relates to a low water flush toilet and in particular to a toilet having a pulsator for providing uniform pulses of flush water to the bowl to produce consistent and repeatable flushing operation.

Water shortages and a general trend toward water conservation have lead to the use of low water flush toilets. In some geographic areas building codes require the use of low water flush toilets. The water supply in a recreational vehicle may be limited such that conservation of flush water by an RV toilet is essential.

As a result, many low water flush toilets have been developed. Several of these toilets, however, suffer from one or more deficiencies. A major problem with several of these toilets is insufficient cleaning of the bowl surface due to the smaller quantity of water used in flushing. This deficiency can at often times be caused by failure of the flush water to wet the entire bowl surface. If a portion of the bowl surface is not wetted by the flush water, that surface can not be properly cleaned. One factor contributing to unwetted bowl surfaces is the manner in which the flush water is delivered to the toilet. Toilets have conventionally been flushed using a rim feed in which a water manifold extends around the bowl with a number of outlets around the bowl periphery. Water flows downwardly from these outlets to the bowl discharge outlet. This arrangement works satisfactory in cleaning the bowl when large quantities of water are used to flush the bowl. Sufficient water is used in each flush to "fan out" from the outlet to cover the entire bowl surface. However, when this arrangement is used in low water toilets, the water may not fan out sufficiently to wet the entire bowl surface.

Some low water flush toilets also require an inlet water supply pressure in excess of 20 psi. In some recreational vehicles, as well as some remotely located buildings, the water supply pressure may not be sufficient to operate these toilets.

It is an object of the present invention to provide a toilet that consistently cleans the bowl surface using a minimum quantity of water.

It is a another object of the invention to provide a toilet in which the entire bowl surface is wetted during flushing.

It is a further object of the present invention to provide a toilet that operates at a minimum water supply pressure.

It is yet a further object of the present invention to provide a low water flush toilet in which the flush operation is repeatable from one flush to another.

The low water toilet of the present invention utilizes a pulsator to produce pulses of flush water discharged into the bowl rather than a steady stream of water. The pulses are discharged from a nozzle in a horizontal direction onto a generally horizontal ledge around the periphery of the bowl adjacent its upper end. The water discharged at the beginning of each pulse has a higher velocity than the water discharged at the end of each pulse. The higher velocity water flows a greater distance around the periphery of the bowl prior to falling off the ledge and wetting the bowl surface than the lower velocity water. The differing water velocities in each pulse results in water falling off the ledge around the entire periphery of the bowl and following a generally swirling path around the bowl, wetting the entire bowl surface.

The swirling path of the water results in a longer path of travel for the water from the nozzle to the bowl discharge outlet compared to conventional rim feed toilets in which the flush water flows directly down from the rim to the outlet. The swirl pattern thus increases the bowl surface covered by the water, allowing less water to be used without sacrificing flush performance.

The pulsator produces uniform pulses of flush water regardless of the water supply pressure resulting in consistent and repeatable flush operation.

The single horizontal water discharge onto the ledge coupled with the pulsed discharge of water produces a flush in which the entire bowl surface is wetted, enabling the surface to be cleaned using a minimum quantity of water and also results in a consistent and repeatable flushing operation.

Further objects, features and advantages of the invention become apparent from a consideration of the following description and appended claims when taken in conjunction with the accompanying drawings.

DETAILED DESCRIPTION OF THE INVENTION

Figure 1:
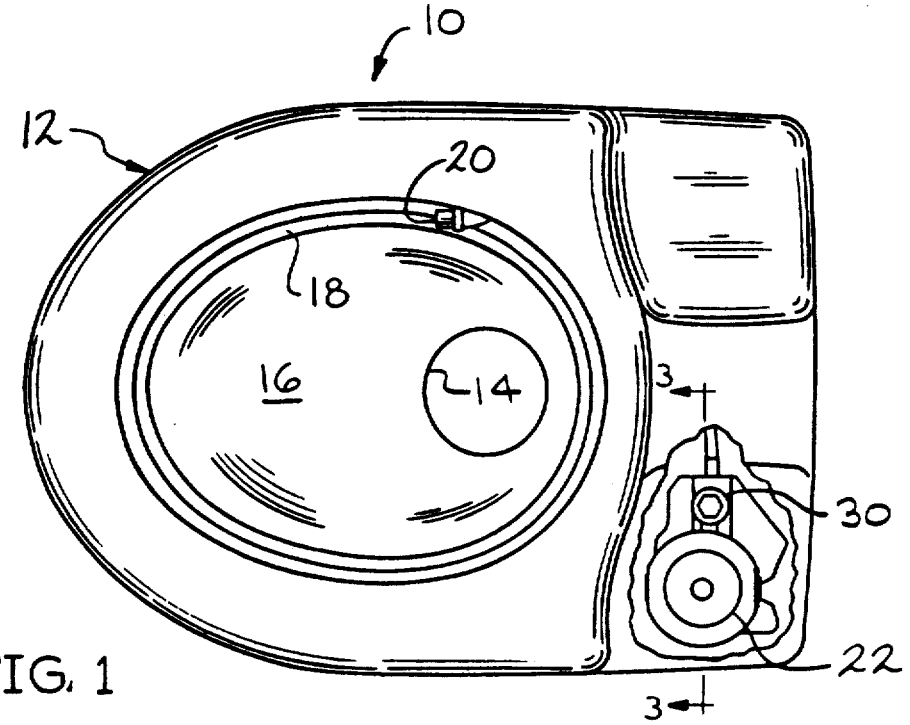
FIG. 1 is a partially broken away plan view of the low water flush toilet of the present invention.
Figure 2:
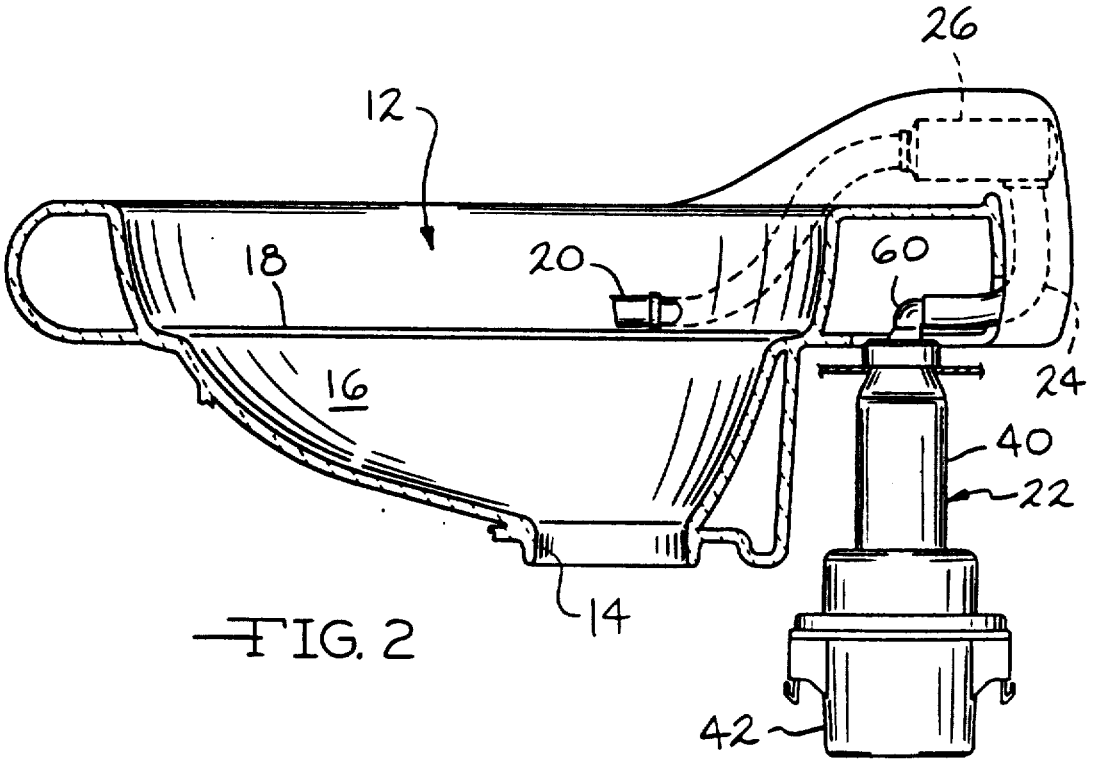
FIG. 2 is a side partial elevational and partial sectional view of the toilet of FIG. 1.

The low water flush toilet of the present invention is shown in FIGS. 1 and 2 and designated generally at 10. The toilet 10 includes a bowl section 12 open at its upper end and having a lower discharge outlet 14. The inner surface 16 of the bowl 12 is formed with a ledge 18 extending around the bowl near its upper end. As used throughout the specification and claims, the term "ledge" is used to refer to a portion of the bowl surface 16 having a slope or incline that is closer to horizontal than the slope of the surrounding bowl surface both below and above the ledge. A single flush water nozzle 20 directs flush water onto the ledge 18 so that the flush water flows on the ledge 18 around the periphery of bowl 12. As the velocity of the flush water slows, the water will gradually fall off the ledge 18 flowing over the bowl surface 16 to the outlet 14. A pulsator 22 produces flush water pulses flowing through flush water conduit 24 to nozzle 20. Conduit 24 includes a back flow restrictor 26 to prevent any water from being drawn back into the conduit 24 from the bowl.

The structure and operation of the pulsator 22 is best shown and described in conjunction with FIGS. 3 through 7. Pulsator 22 includes a water inlet 28 which receives water from a flush valve 30. Flush valve 30 is normally closed and is actuated by rod 32 to an open position enabling water to flow through valve 30 into the pulsator 22. The pulsator is constructed of a two-piece housing formed by upper housing 40 and lower housing 42 joined together by nut and bolt assemblies 44. The housing forms a tubular upper portion 34 and a main body lower portion 36 forming an internal chamber 38 concentric about axis 39.

Figure 3:
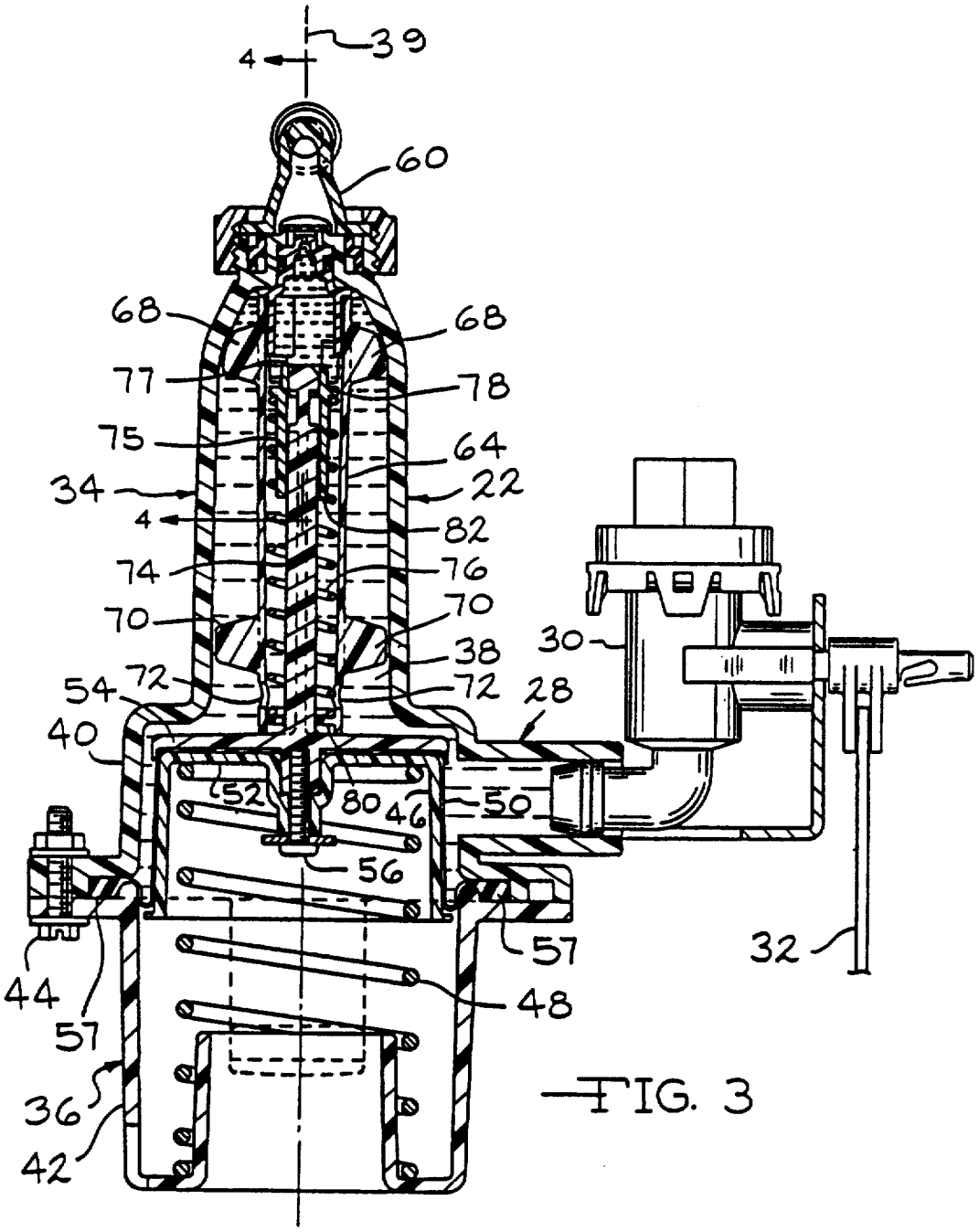
FIG. 3 is a sectional view of the pulsator.
Figure 4:
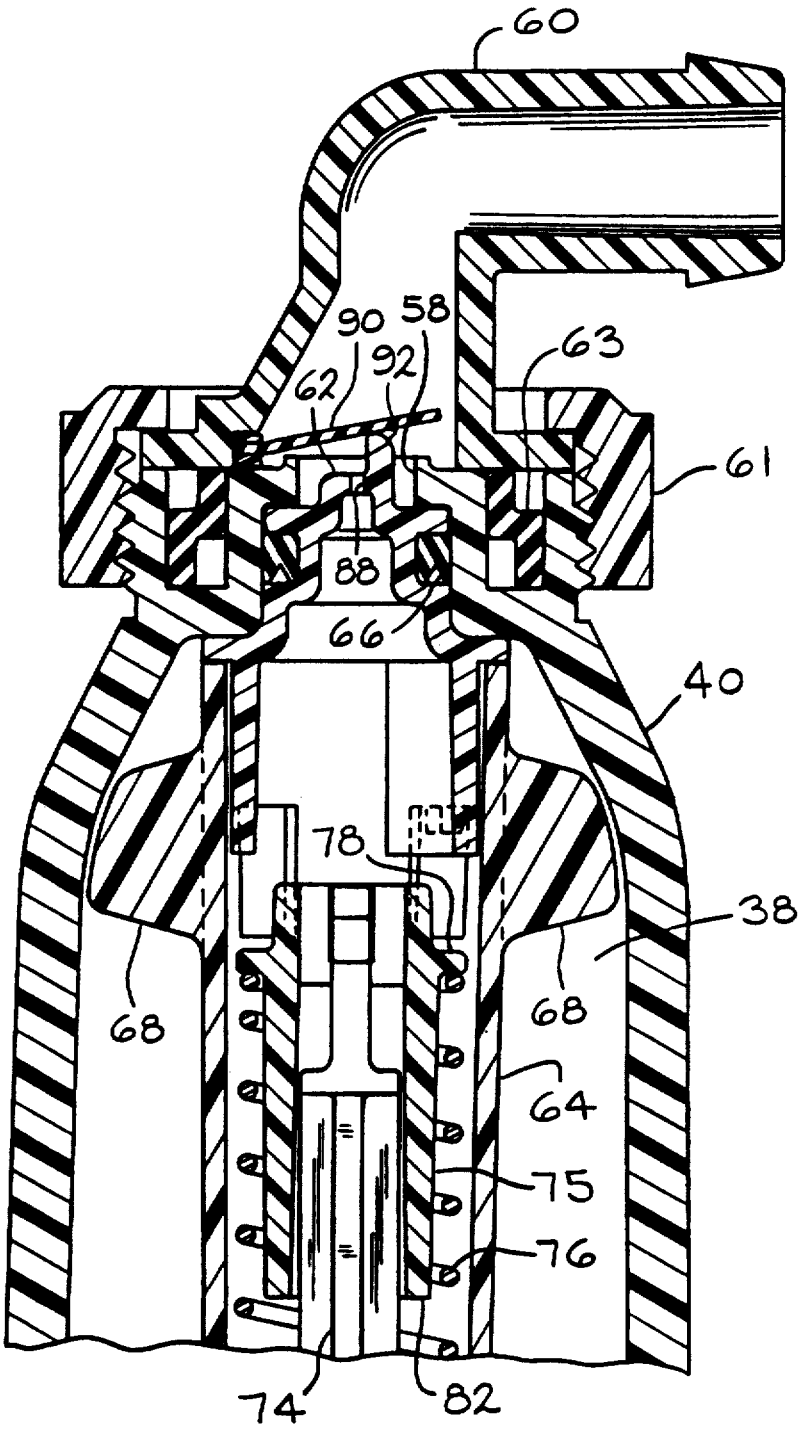
FIG. 4 is a large sectional view of the top portion of the pulsator as seen from substantially the line 4—4 of FIG. 3.
Figure 6:
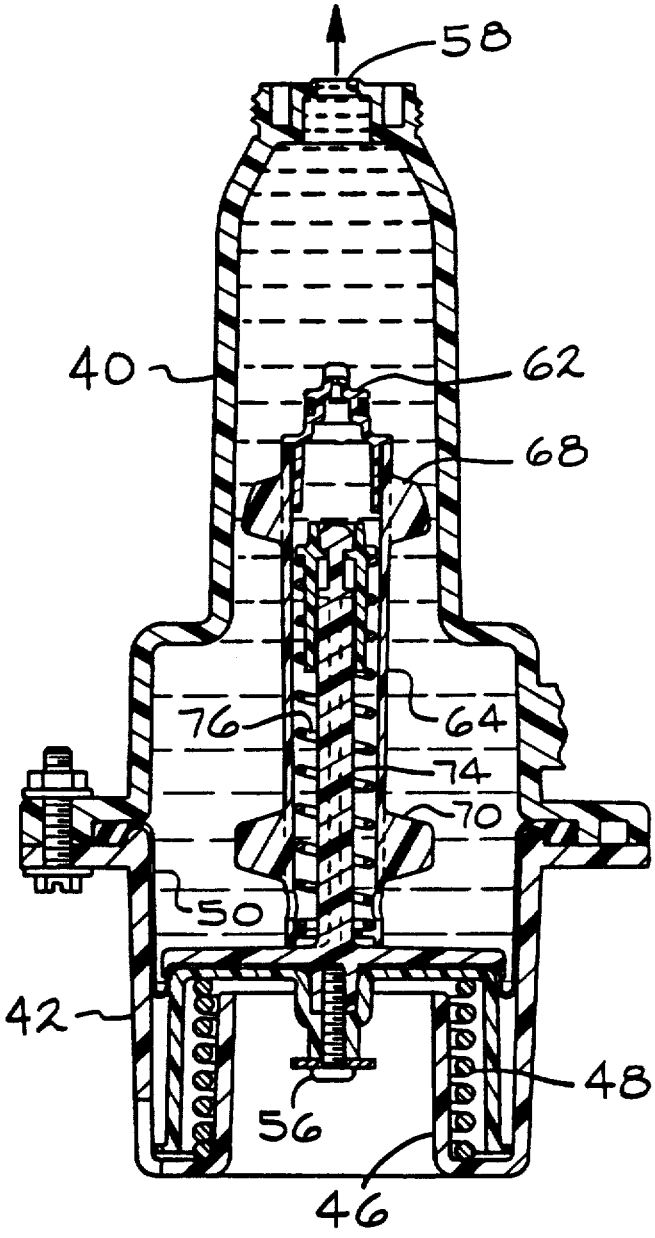
FIG. 6 is a sectional view of the pulsator similar to FIG. 5 with the pulsator filled with water immediately after opening the pulsator outlet.
Figure 7:
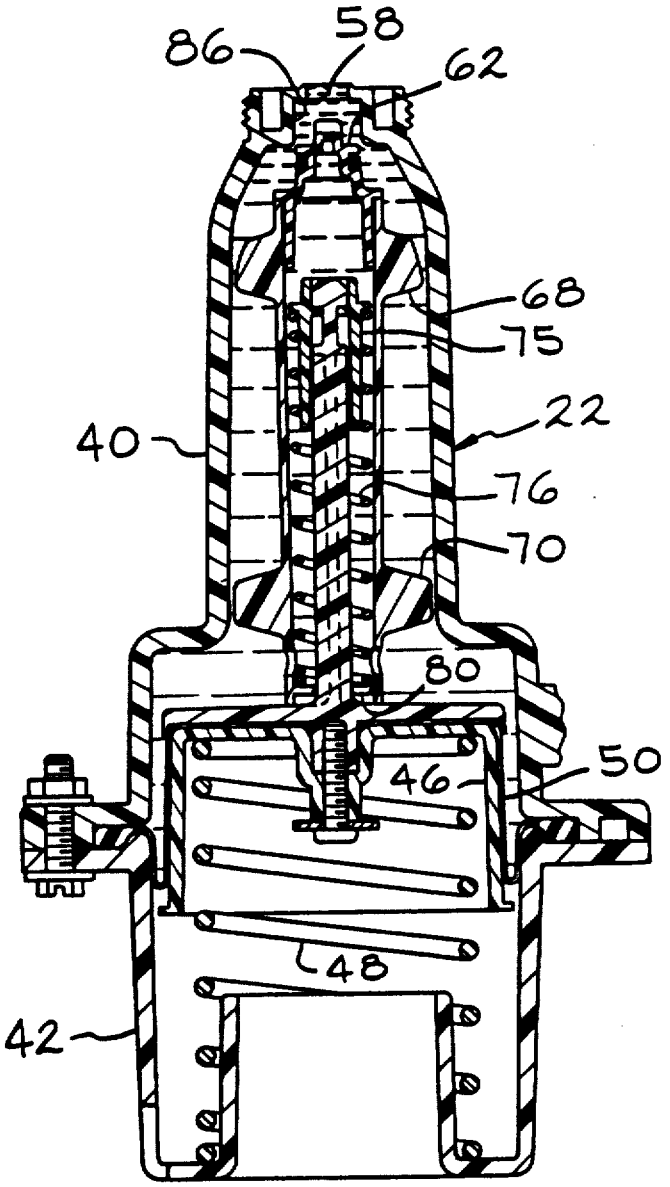
FIG. 7 is a sectional view of a pulsator immediately after discharge of a water pulse just prior to closing the pulsator outlet.

A generally inverted cup shaped piston 46 is disposed in the lower portion of the pulsator and is axially movable between a raised position shown in FIG. 3 and a lowered position shown in FIG. 6. The volume of internal chamber 38 increases as the piston 46 moves from the raised position to the lowered position. A biasing spring 48 urges the piston 46 to its raised position corresponding to the minimum volume of the chamber. A rollsock diaphragm 50 is secured to the piston base 52 by a retaining member 54. The retaining member is secured to the piston base by screw and washer assembly 56. The outer periphery 57 of the diaphragm is enlarged in section forming a sealing ring sandwiched between the upper and lower housings 40 and 42 forming a seal between the housings. Diaphragm 50 defines the lower boundary of the internal chamber 38. As the piston 46 is lowered, moving the diaphragm lower, the volume of internal chamber 38 increases. The lower housing 42 is open below piston 46.

When valve 30 is opened, the pressure of water flowing into chamber 38 forces the piston 46 downward in opposition to biasing spring 48, increasing the volume of chamber 38 as water flows therein. Energy is stored in spring 48.

The top of upper housing 40 forms a discharge orifice 58 concentric about axis 39 leading to fitting 60 which is secured to upper housing 40 by threaded collar 61 and is sealed by seal member 63. Fitting 60 is coupled to the flush water conduit 24, directing flush water from the pulsator to the flush water nozzle 20.

The discharge orifice 58 is closed by cap 62 fixed to the top of spool 64. A seal 66 surrounding cap 62 forms a leak tight engagement of the cap with the neck 86 leading to orifice 58. The spool 64 is generally cylindrical with upper and lower fins 68 and 70 respectively extending radially outward to guide axial motion of the spool as described below. The spool body includes openings 72 to admit water into the interior of the spool.

Figure 5:
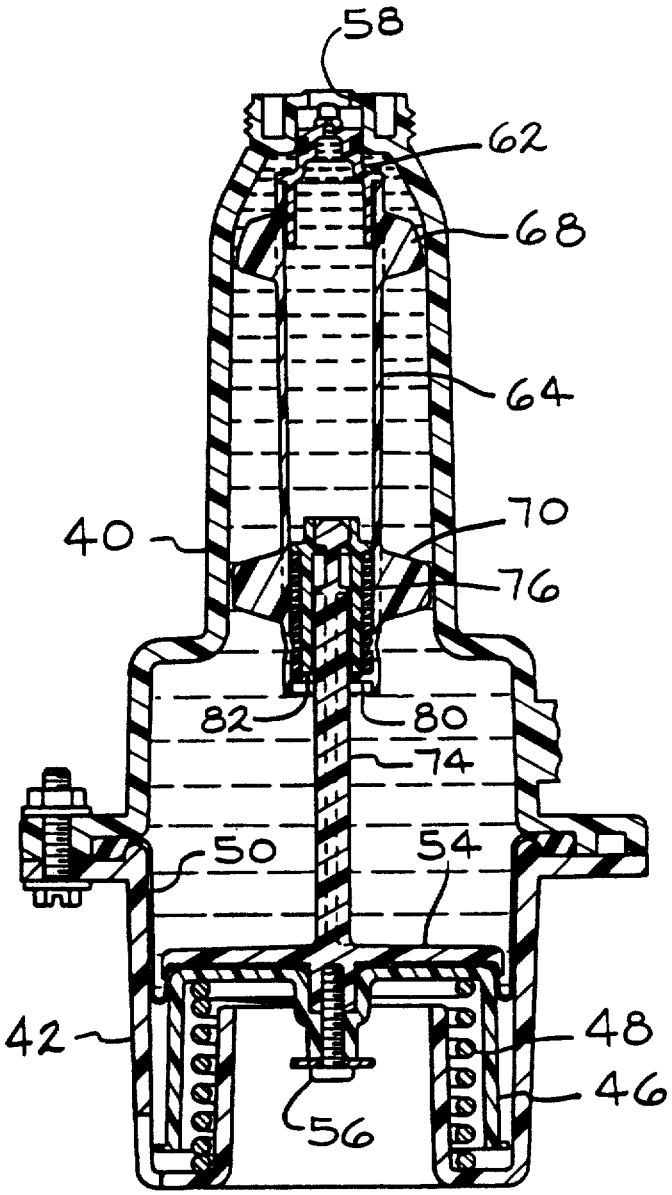
FIG. 5 is a sectional view of the pulsator filled with water immediately before discharge of a pulse of flush water.

As shown in FIG. 3, the discharge orifice 58 is closed and the piston 46 is in the raised position. With the valve 30 closed, the water pressure in chamber 38 will be substantially atmospheric as discussed below. When valve 30 is open, water will flow into chamber 38 increasing the internal pressure until it is sufficient to overcome biasing spring 48, enabling the piston 46 to be lowered. The water within spool 64 will act upon the interior surface of cap 62 holding the spool 64 in place closing outlet orifice 58. The opposing pressure on cap 62 in the fitting 60 is either atmospheric pressure or the pressure of water in the conduit 24. The retaining member 54 includes a stem 74 extending longitudinally into the interior of spool 64 to couple the piston with the spool. A collar 75 is attached to stem 74 by a rotating interlocking coupling. Collar 75 is pushed up against the enlarged head 77 of the stem by release spring 76 surrounding the stem. Spring 76 is retained between radial shoulder 78 on collar 75 and shoulder 80 extending radially inwardly from spool 64. As the piston 46 is lowered, the stem 74 is also lowered, compressing the release spring 76. The water pressure in the spool exerts a greater upward force on the spool than the downward force exerted by the spring 76. When the piston 46 approaches its lowered position, the lower annular surface 82 of the collar 75 contacts the radial shoulder 80 at the base of the spool. In this position, the release spring 76 is fully compressed. Continued downward movement of the piston 46 retracts the spool 64 from orifice 58. FIG. 5 illustrates the pulsator 22 when the spool has been slightly retracted from orifice 58. Once the orifice is opened, the fluid pressure acting on both sides of the cap 62 is substantially equalized, enabling the compressed spring 76 to move spool 64 downward to the position shown in FIG. 6.

The water flow rate through the outlet orifice 58 is greater than the incoming flow rate through inlet 28 such that the pressure within the internal chamber is decreased sufficiently for biasing spring 48 to move the piston 46 upward, discharging a substantial portion of the water in a single pulse.

As the piston 46 approaches the raised position, the cap 62 of the spool will restrict the flow of water through outlet orifice 58 as the spool cap approaches the neck 86. As a result of the reduced flow rate through outlet orifice 58 and the continuing water inflow through inlet 28, the chamber begins to fill again, moving the piston downward in opposition to the biasing spring 48 beginning the next cycle of the pulsator. The pulsator continues to cycle, discharging pulses of flush water, as long as the valve 30 remains open.

A bleed hole 88 is formed in cap 62. In the event that the valve 30 is closed while the internal chamber 38 is partially filled, the bleed hole 88 allows the pressure in the chamber 38 to slowly be relieved by water flowing through the bleed hole 88 into the flush conduit 24. This enables the internal pulsator pressure to be relieved while it is idle between flushes.

The bleed hole 88 also aids in removing water from the system for winterization when the toilet is installed in recreational vehicles, summer homes and the like. By disconnecting the incoming water source and providing a lower drain opening, the water in the flush conduit 24 as well as the pulsator can be drained from the system.

A flapper valve 90 is positioned in the tube 60 immediately above the outlet orifice 58. Extension 92 of the cap 62 extends through orifice 58 preventing the flapper valve from completely closing the orifice 58. It has been found that as the spool closes orifice 58, the water flowing through fitting 60 produces a slight vacuum upstream, causing a portion of the water to flow backwards from fitting into the pulsator. The backflowing water can prevent the spool from fully closing the orifice 58. Flapper valve 60 prevents the backflowing water from effecting the position of the spool.

The water from each pulse is discharged onto the ledge 18 in the bowl 12. The water discharged at the beginning of each pulse has a higher velocity than the water at the end of the pulse. The water velocity is reduced at the end of the pulse due to the fact that the force of the spring is progressively spent during the course of each pulse discharge. The higher velocity water travels a greater distance around the bowl before falling off the ledge than does the lower velocity water. As a consequence, water will fall off the ledge around substantially the entire periphery of the bowl resulting in the entire bowl surface being wetted and cleaned with water from each pulse.

The ledge and water discharge onto the ledge produces a swirling or rotating flow of the water in the bowl. The swirling water travels a greater distance over the bowl surface compared to water from a conventional rim feed toilet that flows straight down the bowl surface to the bowl outlet. By combining the rotational travel of the water with the pulse discharge of varying water velocities, the entire bowl surface is cleaned using a minimum quantity of water.

The desired discharge volume of each pulse will be based on the size and shape of the toilet bowl. The water pressure within each pulse varies between approximately 4 and 8 psi. The supply water pressure must be greater than 8 psi to produce full compression of the spring 48. The onboard water supply pressure in a recreational vehicle may vary from 10 to 20 psi. When the toilet is connected to a municipal water system the pressure may be any where between a low of 20 psi to as much as 100 psi. To avoid overpowering the spring 48, creating a situation where the spring remains depressed and never moves to the shut off portion, a pressure regulator (not shown) is required upstream of the pulsator 22. The pressure is regulated to no more than 35–40 psi. The pulsator 22, which uses the spring 48 to supply pressure to each pulse, will produce consistent and repeatable flush operation regardless of the water supply pressure.

It is to be understood that the invention is not limited to the exact construction illustrated and described above, but that various changes and modifications may be made without departing from the spirit and scope of the invention as defined in the following claims.

We claim:

1. A low water flush toilet comprising:

a bowl having an open upper end and a bottom discharge outlet through which waste is flushed from said bowl, said bowl having a ledge near the upper end thereof;

a flush water nozzle disposed in said bowl for discharging flush water onto said ledge to flow circumferentially around said bowl on said ledge, said water falling off said ledge and flowing circumferentially over said bowl surface to said discharge outlet; and means for flushing waster from said bowl with flush water discharged from said nozzle into said bowl, said flush means including valve means to connection with a water supply separate from said toilet and having a water pressure above a predetermined minimum, said valve means being normally closed, actuator means for opening said valve means when desired, and pulse means disposed between said valve means and said nozzle for producing a pulse of flush water for discharge into said bowl through said nozzle, the water of said pulse being discharged into said bowl at varying velocities so that water falls off said ledge to wet substantially all of said bowl as said water flows to said discharge outlet.

2. The low water flush toilet of claim 1 wherein said pulse means produces pulses of water with the water of each pulse being discharged with varying velocity.

3. The water flush toilet of claim 1 wherein said pulse means includes a water inlet, an internal water chamber, an outlet orifice, a closure for opening and closing said outlet orifice and variable volume means for varying the volume of said chamber, said variable volume means being operable to rapidly decrease the volume of said chamber once said chamber is filled with water to a maximum volume whereby water in said chamber is discharged through said orifice in a single pulse.

4. The low water flush toilet of claim 3 wherein said variable volume means includes moveable piston means and spring means for biasing said piston means to a position corresponding to the minimum volume of said chamber, said spring means being overcome by water pressure from said inlet when said chamber is in communication with said water supply whereby said piston is moved to a position increasing the volume of said chamber as water flows into said chamber.

5. The low water flush toilet of claim 4 further comprising means coupling said piston means to said closure for moving said closure to a position opening said orifice when said piston means reaches the maximum volume position of said chamber, the opening of said orifice decreasing the water pressure in said chamber sufficiently for said spring means to move said piston means to said minimum volume position discharging water from said chamber.

6. A low water flush toilet comprising:

a bowl having an open upper end and bottom discharge outlet through which waste is flushed from said bowl, said bowl having a ledge near the upper end thereof;

a flush water nozzle disposed in said bowl for discharging flush water onto said ledge to flow circumferentially around said bowl on said ledge after which said water falls off said ledge over said bowl surface to said discharge outlet; and means for flushing waste from said bowl with pulses of flush water discharged from said nozzle into said bowl, said flush means including valve means for connection with a water supply having a pressure greater than a predetermined minimum, said valve means being normally closed, actuator means for opening said valve means when desired, and pulsator means having an inlet in communication with said valve means, an outlet in communication with said nozzle, a closure for opening and closing said outlet, a water chamber, and means for discharging water from said chamber in a single pulse of water through said outlet when said chamber is filled with water, said water in each pulse being discharged into said bowl at varying velocities so that said water falls off said ledge to substantially wet the entire surface of said bowl below said ledge.

7. The low water flush toilet of claim 6 wherein said discharge means includes a moveable piston with said chamber, said piston being moveable from a chamber minimum volume position to a chamber maximum volume position as water flows into said chamber and moveable back to said chamber minimum volume position to discharge a pulse of water from said chamber into said bowl, said piston continually moving between said minimum and maximum volume positions of said piston as long as said valve means is open.

8. The low water flush toilet of claim 7 further comprising means coupling said piston to said closure for opening said outlet when said piston is moved to said chamber maximum volume position.

9. The low water flush toilet of claim 8 wherein said discharge means includes spring means to bias said piston to the chamber minimum volume position, when said valve means is open and said chamber outlet is closed, pressure of the water supply acts on said piston forcing said piston to said chamber maximum volume position and water pressure in said chamber being reduced sufficiently when said closure opens said outlet for said spring means to move said piston to said chamber minimum volume position discharging water from said chamber.

10. The low water flush toilet of claim 6 wherein said discharge means includes a piston in said chamber moveable from a chamber maximum volume position to a chamber minimum volume position to discharged water from said chamber and spring means for biasing said piston to said minimum chamber volume position whereby when said closure is in position closing said outlet and said inlet is in communication with said water supply, the water supply pressure moves said piston to said maximum chamber volume position allowing water to flow into said chamber;

said discharge means further including means for coupling said piston to said closure for opening said outlet when said piston approaches the chamber maximum volume position reducing the water pressure in said chamber whereby said spring means moves said piston to said chamber minimum volume position discharging water from said chamber.

11. The low water flush toilet of claim 10 wherein said pulsator means includes a housing surrounding said piston and further comprising a rollsock diaphragm extending from said piston to said housing and sealed thereto.

12. The low water flush toilet of claim 11 wherein said chamber has an axis, said piston and said outlet being concentric about said axis and said piston being moveable axially.

13. The low water flush toilet of claim 12 wherein said closure is axially moveable within said chamber between positions opening and closing said outlet, said closure, when in the closed position having a surface exposed to water in said chamber, whereby water pressure in said chamber acts on said surface to hold said closure in the closed position.

14. The low water flush toilet of claim 13 wherein said closure is an axially elongated hollow spool closed at one end for closing said outlet and open at the other end, said coupling means including an elongated stem extending from said piston into said hollow spool through said open end, said stem having an outwardly extending shoulder and said spool having an inwardly extending shoulder which engage one another to prevent complete withdrawal of said stem from said spool, said shoulders positioned relative to one another so as to engage one another as said piston nears said chamber maximum volume position whereby continued movement of said piston to said chamber maximum volume position moves said closure toward said open position.

15. The low water flush toilet of claim 14 further comprising spring means for biasing said spool toward said piston when said piston is in a position opening said outlet.

* * * * *